US007654005B2

(12) United States Patent
Perrin

(10) Patent No.: US 7,654,005 B2
(45) Date of Patent: Feb. 2, 2010

(54) TWO-PIECE ASSEMBLY, ASSEMBLY KIT AND METHOD OF ACHIEVING AN ASSEMBLY

(76) Inventor: Laurent Perrin, La Prise-Roulet 6, 2013 Colombier (CH)

( * ) Notice: Subject to any disclaimer, the term of this patent is extended or adjusted under 35 U.S.C. 154(b) by 484 days.

(21) Appl. No.: 11/476,683

(22) Filed: Jun. 29, 2006

(65) Prior Publication Data

US 2007/0022612 A1 Feb. 1, 2007

(30) Foreign Application Priority Data

Jul. 28, 2005 (EP) ..... 05106982

(51) Int. Cl.
*B26B 13/00* (2006.01)

(52) U.S. Cl. ..... 30/194; 30/252; 30/254

(58) Field of Classification Search ..... 30/194, 30/252, 254, 249, 340, 341; 285/253; 7/125, 7/129, 105, 167; 81/177.2, 423, 489, 180.1, 81/436–446; D8/107, 303, 312, 83
See application file for complete search history.

(56) References Cited

U.S. PATENT DOCUMENTS

| | | | | |
|---|---|---|---|---|
| 564,741 | A | 7/1896 | Dunn | |
| 3,722,903 | A * | 3/1973 | Jones | 280/823 |
| 4,744,690 | A * | 5/1988 | Hsieh | 403/104 |
| 4,753,459 | A | 6/1988 | Potier | |
| 4,905,353 | A | 3/1990 | Gari | |
| 5,165,686 | A * | 11/1992 | Morgan | 473/564 |
| 5,404,616 | A * | 4/1995 | Carmien | 16/422 |
| 5,454,165 | A * | 10/1995 | Thompson et al. | 30/249 |
| 6,712,376 | B2 * | 3/2004 | Eberhardt et al. | 280/293 |
| 6,883,208 | B1 * | 4/2005 | Huang | 16/429 |
| 7,195,377 | B2 * | 3/2007 | Tsai | 362/431 |
| 2002/0096882 | A1 * | 7/2002 | Stripe | 285/253 |
| 2002/0128087 | A1 * | 9/2002 | Tilley | 473/319 |
| 2003/0154829 | A1 | 8/2003 | Lin Wu | |

FOREIGN PATENT DOCUMENTS

| | | |
|---|---|---|
| DE | 77 06 847 U1 | 6/1977 |
| EP | 0 357 490 B1 | 1/1993 |
| FR | 2 588 354 A1 | 4/1987 |
| FR | 2 798 087 A1 | 9/2001 |
| FR | 2 814 389 A1 | 3/2002 |
| FR | 2 860 388 | 4/2005 |

* cited by examiner

*Primary Examiner*—Ghassem Alie
(74) *Attorney, Agent, or Firm*—Oliff & Berridge, PLC

(57) ABSTRACT

An assembly having a first piece and a hollow second piece, the first piece having upper and lower parts which are connected by a hinge-forming part and form a space, a part of the second piece being accommodated in the space, the hollow second piece includes a cavity and a bushing is provided in at least part of the cavity, the bushing being provided at a level of a part of the hollow second piece that is accommodated in the first piece. The assembly further has a clamping unit that brings together the upper and lower parts of the first piece. The assembly relates in particular to the manufacture of tools for cutting, shearing, clamping or gripping, such as pruning shears. The assembly also concerns an assembly kit and a method for achieving an assembly.

7 Claims, 4 Drawing Sheets

TWO-PIECE ASSEMBLY, ASSEMBLY KIT AND METHOD OF ACHIEVING AN ASSEMBLY

The invention concerns an assembly having two pieces, in particular, a piece with high mechanical resistance and a piece with low radial mechanical resistance. It applies in particular to the manufacture of tools for cutting, shearing, clamping or gripping, such as shears, pruning shears, nippers, nipper pliers, etc. The invention likewise concerns an assembly kit and a method for achieving an assembly.

STATE OF THE ART

In March 1990, the publication of the European patent application No. 357 490 disclosed cutting or shearing tools with handles of composite material. The use of a composite material for the handles of course aimed to reduce the weight of the tool. The tools manufactured according to the teachings of this document have admittedly a reduced weight with respect to their entirely metallic counterparts, but they have not had the technical and commercial success expected because the connection between the handles of composite material is not satisfactory. In fact, this connection is achieved by means of bolts passing through the entire width of the composite material, this creating an embrittlement of this material, leading to its cracking or breaking during use, even under normal conditions, this owing to the concentration of forces on the small surfaces of the material in contact with the bolts.

Despite the numerous attempts made subsequently, and reflected notably by the documents FR-A-2 798 087 (published in 1999), FR-A-2 814 389 (published in 2000) and US-A-2003/0154829 (published in 2003), there still does not exist a cutting or shearing tool having handles of composite material and having sufficient mechanical resistance to be able to be used under even normal conditions.

It is thus in searching intensely for a solution to the problem consisting in succeeding in manufacturing satisfactory hand tools having a composite handle or handles that the inventor has finally managed to perfect a new type of joint permitting an assembly to be achieved between a first piece in a material of high mechanical resistance, such as forged and tempered aluminum, and a hollow second piece made of a material having a low radial mechanical resistance, such as a pultruded composite material.

SUMMARY OF THE INVENTION

The invention thus has as its object an assembly having a first piece and a hollow second piece, this assembly having these particularities

- the first piece has an upper part and a lower part which are connected by a hinge-forming part, and form between them a space;
- a part of the hollow second piece is accommodated in said space; and
- the hollow second piece is provided, in at least part of its cavity, at the level of its part accommodated in the first piece, with a bushing;

and it further comprises

- clamping means bringing together said upper and lower parts of the first piece so as to grip the hollow second piece so that it is kept in position inside the first piece.

Such an assembly allows transmission of high forces from the one piece to the other.

According to one embodiment of the invention, the bushing extends over a length at least equal to the length of the part (of the hollow second piece) which is accommodated in the first piece.

According to another embodiment of the invention, the first piece is composed of a metal or a metal alloy.

According to still another embodiment of the invention, the hollow second piece is made up of a composite material. The composite material is preferably composed of a polymeric matrix reinforced with carbon fibers, which are preferably pultruded carbon fibers.

According to still another embodiment of the invention, the clamping means are made up of at least one screw.

According to another aspect, the invention relates to an assembly kit, having the elements which will be described, whose dimensions and shapes are such that they are able to co-operate with one another to achieve an assembly according to the invention.

According to an embodiment of the assembly kit according to the invention, the relative dimensions, on the one hand, of the space formed by the upper and lower parts of the first piece, and, on the other hand, of the hollow second piece, are such that functional play exists when the hollow second piece is inserted in said space.

According to another embodiment, the relative dimensions, on the one hand, of the bushing and, on the other hand, of the cavity of the hollow second piece, are such that functional play exists when the bushing is inserted in said cavity.

The invention also relates to a method for achieving an assembly according to the invention. This method has the following steps:

providing:

a) a first piece having an upper part and a lower part, which are connected by a hinge-forming part, and form between them a space;

b) a hollow second piece;

c) a bushing; and d) clamping means;

these elements a) to d) being of course able to co-operate with one another to achieve an assembly according to the invention, i.e. their dimensions and shapes are designed to that effect;

- inserting the bushing in the cavity of the hollow second piece;
- inserting the hollow second piece in the space formed between the upper and lower parts of the first piece, in such a way that the bushing is situated at the level of the part of the hollow second piece accommodated in said space; and
- actuating the clamping means so that they bring together said upper and lower parts of the first piece, in such a way as to grip the hollow second piece so that it is kept in position inside the first piece.

The assembly according to the invention can be used in a great many applications, among which may be mentioned the achieving of tripods for photographic devices or cameras, the production of light-weight bicycle frames, golf clubs, etc.

Furthermore, the two-piece assembly is particularly strong, making it possible to be used in applications involving the transmission of very powerful forces. The manufacture of tools can be mentioned in this regard.

The invention thus likewise relates to a cutting, shearing, clamping or gripping tool having two arms connected to one another by means of an articulation, each arm having a cutting part, a transmission part and a manipulation part or handle, this tool having the particularity that it further comprises, between the transmission part and the manipulation part, a connection part, this connection part forming with the manipulation part or handle an assembly such as described in the foregoing, in which the connection part constitutes the first piece and the handle the hollow second piece, the fastening of the connection part to the transmission part being achieved in a way known to one skilled in the art.

According to an advantageous embodiment, the connection part is of aluminum or an aluminum alloy, preferably forged and tempered, and the manipulation part is made of carbon fibers, preferably pultruded.

According to a preferred embodiment of the invention, the tool is a pair of pruning shears for two hands.

The different embodiments which will be disclosed can be envisaged separately or in combination, depending upon needs.

BRIEF DESCRIPTION OF THE DRAWINGS

Other features and advantages of the invention will now be described in detail in the specification which follows and which is given with reference to the attached figures, representing schematically.

DETAILED DESCRIPTION OF THE INVENTION

Assembly According to the Invention

Figure 1:
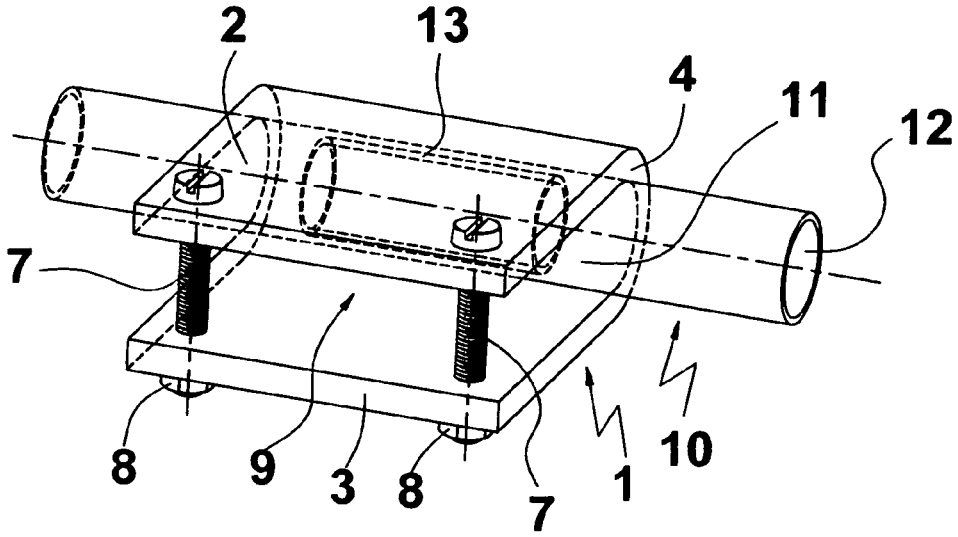
FIG. 1: an assembly according to the invention.

The assembly according to the invention is shown in a general way in FIG. 1.

Figure 2:
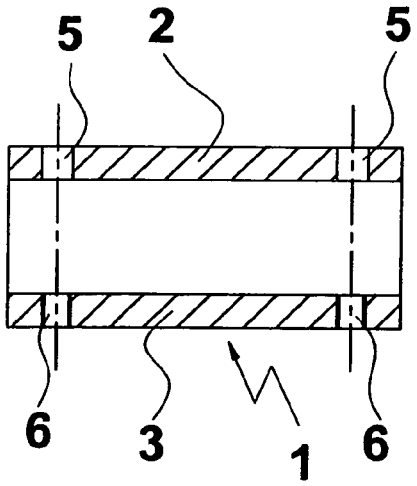
FIGS. 2 and 3: the first piece of the assembly according to the invention, respectively in a front cutaway view and a left-side view.
Figure 3:
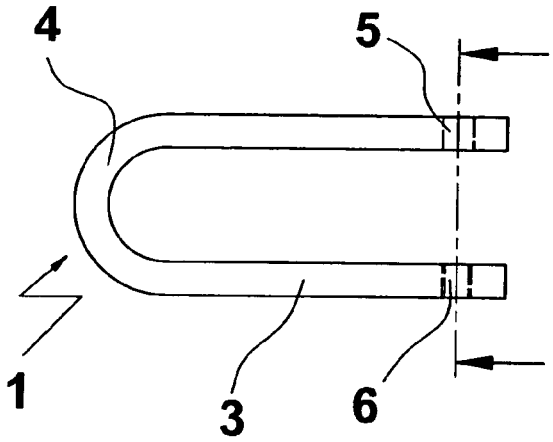

The first piece 1 is represented in detail in FIGS. 2 and 3. To be distinguished are the upper part 2, the lower part 3 and the part forming the hinge 4.

The upper 2 and lower 3 parts have substantially the shape of a plate. At their ends opposite the part forming the hinge 4, they include holes 5 and 6 passed through by screws 7 fixed by nuts 8.

The hinge-forming part 4, which connects them, has the shape of a half cylinder, the thickness of which corresponds to that of the upper and lower parts 2 and 3.

The first piece 1 is generally of metal, and it has a certain flexibility. It can be obtained by bending sheet metal of iron, for example.

It is, however, preferably of tempered aluminum obtained by precision forging, an operation also called "die forging" or "stamping."

According to a variant, the holes 6 are threaded, a screw passing through a hole 5, then being able to screwed into a hole 6.

Situated in a portion of the space 9 formed between the upper 2 and lower 3 parts is a part 11 of the hollow second piece 10. In FIG. 1, the hollow second piece 10 passes through the first piece 1 from one side to the other, but according to a variant, only one end of this piece 10 is contained inside the space 9.

Figure 4:
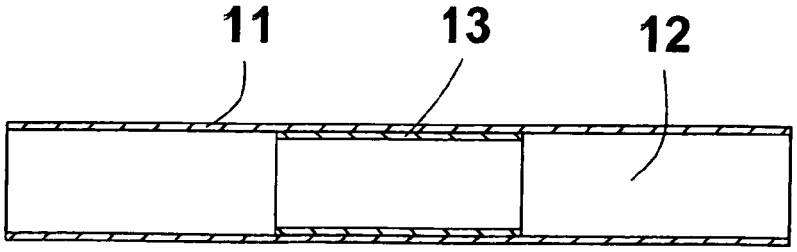
FIGS. 4 and 5: the hollow second piece of the assembly according to the invention, in which the bushing is accommodated, respectively in a front cutaway view and a left-side view.
Figure 5:
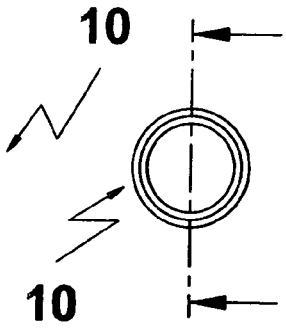

The hollow second piece 10, visible better in FIGS. 4 and 5, generally has the shape of a hollow cylinder. It is preferably composed of a light-weight material, such as a composite material. Cited as examples of composite material can be materials having a polymeric matrix reinforced by fibers. Examples of such materials are given in the previously cited European patent application EP-A-357 490, from line 35 of column 2 to line 14 of column 3.

Used preferably is a polymeric matrix reinforced by carbon fibers, in particular pultruded carbon fibers.

Located on the inside 12 of the piece 10, at the level of the part 11 situated between the upper 2 and lower 3 parts of the piece 1, is a bushing 13 in the shape of a hollow cylinder. The role of this bushing 13 is to reinforce the piece 10 locally. The bushing 13 has high resistance to radial compression, i.e. clearly greater than that of the piece 10. It is generally made of aluminum or an aluminum alloy.

The inventor discovered with surprise that the insertion of such a bushing 13 inside the piece 10 had the effect of endowing it with large-scale resistance to radial compression and of distributing the loads over the entire length of the bushing 13. It resulted in the piece 10 being able to transfer, despite its relative fragility, very great loads to the first piece 1 without bending, buckling, breaking or cracking.

Owing to the flexibility of the first piece 1 and to the hinge-forming part 4, the screwing of the screws 7 in co-operation with the nuts 8 allows the upper part 2 to be brought closer together with the lower part 3, and thus the gripping of the part of the hollow piece 10 located in the space 9, this having the effect of immobilizing the piece 10 with respect to the piece 1.

The bushing 13 represented in FIG. 1 does not extend over the entire length of the part 11, which is located in the space 9, because this is not absolutely necessary in order for the assembly to be suitable for the application for which it is intended. However, if one wishes to maximize mechanical performance of the assembly according to the invention, it is advisable to design the bushing 13 to extend axially at least over the entire axial length of the part 11.

The assembly according to the invention thus has the advantage of being able to withstand very high radial and axial mechanical stresses, even when the piece 10 does not have good mechanical characteristics.

The assembly according to the invention also brings the enormous advantage of making it possible to use in certain applications materials which have not been able to be used until now. Use of a handle of carbon fibers in pruning shears can be mentioned, for example, described in detail in the following.

Assembly Kit According to the Invention

The assembly kit according to the invention includes the first piece 1, the hollow second piece 10, the bushing 13, the screws 7 and the nuts 8. The screws and the nuts 8, which constitute the clamping means, can of course be replaced with any system exerting a force bringing together the upper 2 and lower 3 parts, in order to clamp the first piece 1.

The assembly kit according to the invention is intended to yield, after being put together, the assembly according to the invention. It is to be stated again that the dimensions and shapes of the pieces are selected in harmony with one another.

Preferably, functional play is provided between the piece 1 and the piece 10.

It is also preferable to also provide functional play between the bushing 13 and the cavity 12 of the elongated piece 10.

It is also possible to glue the piece 10 in the piece 1, and the bushing 13 in the cavity 12, but such adhesives render the assembly incapable of being taken apart.

In the absence of adhesives, the functional play has the advantage of enabling an easy putting together and taking apart of the assembly according to the invention. Thus it is possible to dismantle the assembly in order to replace one or the other of the constituent elements, which are defective or inappropriate for the application envisaged, with an element in good condition or more appropriate. This avoids having to replace the entire assembly, and thus enables economization.

The second elongated piece 10 as well as the bushing 13 have a circular cross section in FIGS. 1, 4 and 5. Of course other cross sections are conceivable, notably polygonal cross sections, in particular a hexagonal cross section.

Furthermore, the shape of the first piece 1 can be very different from that represented in FIGS. 1 to 3, upon the condition, however, that it is able to co-operate with the second piece.

Method of Achieving an Assembly According to the Invention

Achieving an assembly starting with an assembly kit such as described in the foregoing includes the following steps:

- inserting the bushing 13 in the cavity 12 of the hollow second piece 10;
- inserting the hollow second piece 10 in the space 9 formed between the upper 2 and lower 3 parts of the first piece 1, in such a way that the bushing 13 is situated at the level of the part of the elongated hollow second piece 10 accommodated in said space 9; and
- actuating the clamping means 7,8 so that it brings closer together said upper 2 and lower 3 parts of the first piece 1, in such a way as to clamp the hollow second piece 10 so that it is kept in position inside the first piece 1.

If functional play is provided in each case between, on the one hand, the pieces 1 and 10 and, on the other hand, the pieces 13 and 10, assembly takes place easily and by hand.

The invention can be implemented in a number of fields. Its use as a cutting, shearing, clamping or gripping tool, such as scissors, pruning shears, pincers, pliers, tongs, nippers, clippers, clamp, etc., will now be described.

Cutting, Shearing, Clamping or Gripping Tool

Figure 6:
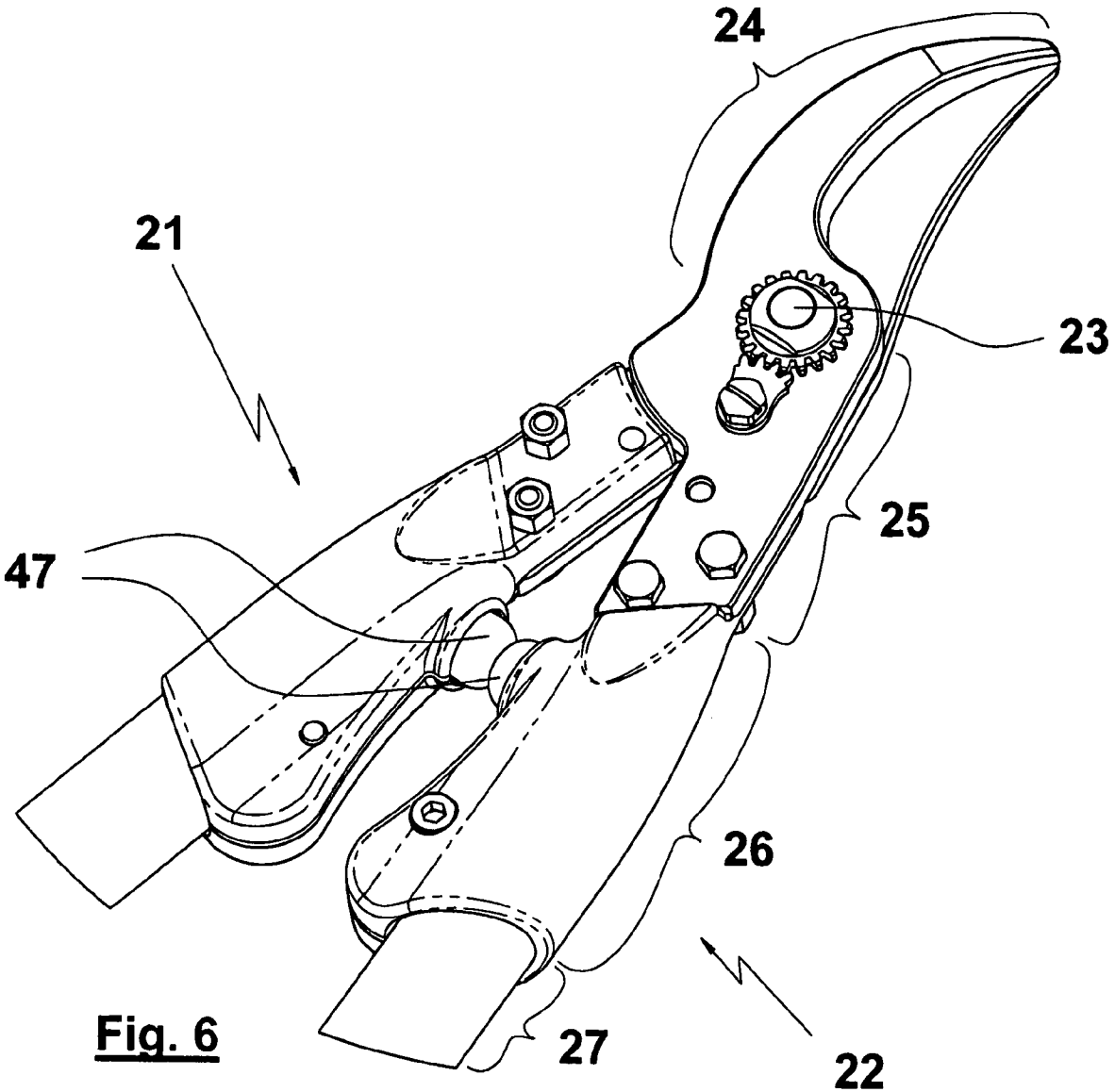
FIG. 6: pruning shears for two hands incorporating an assembly according to the invention in each handle.

Cited as an example of such a tool can be pruning shears for two hands. Such shears are represented in FIG. 6. They include two arms 21 and 22, connected to one another by means of an articulation 23, each arm having a cutting part 24, a transmission part 25, a connecting part 26 and a manipulation part or handle 27.

Figure 7:
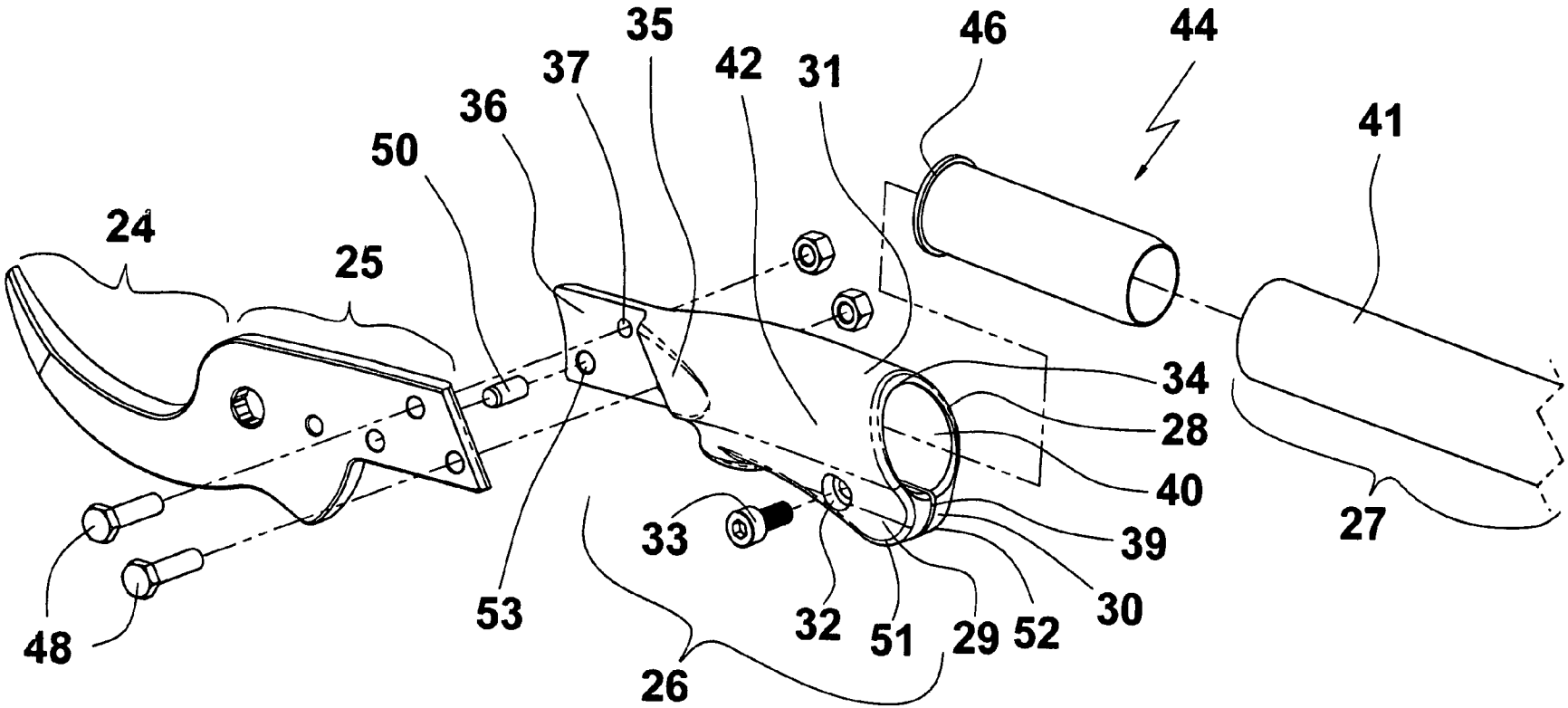
FIG. 7: an exploded view of one of the arms of the pruning shears according to FIG. 6.

As can be seen in particular in FIG. 7, the cutting 24 and transmission 25 parts form a single piece, generally of tempered steel. The materials, shapes and dimensions of such a piece as well as the design of an articulation 23 are well known by manufacturers of tools of this type.

Figure 8:
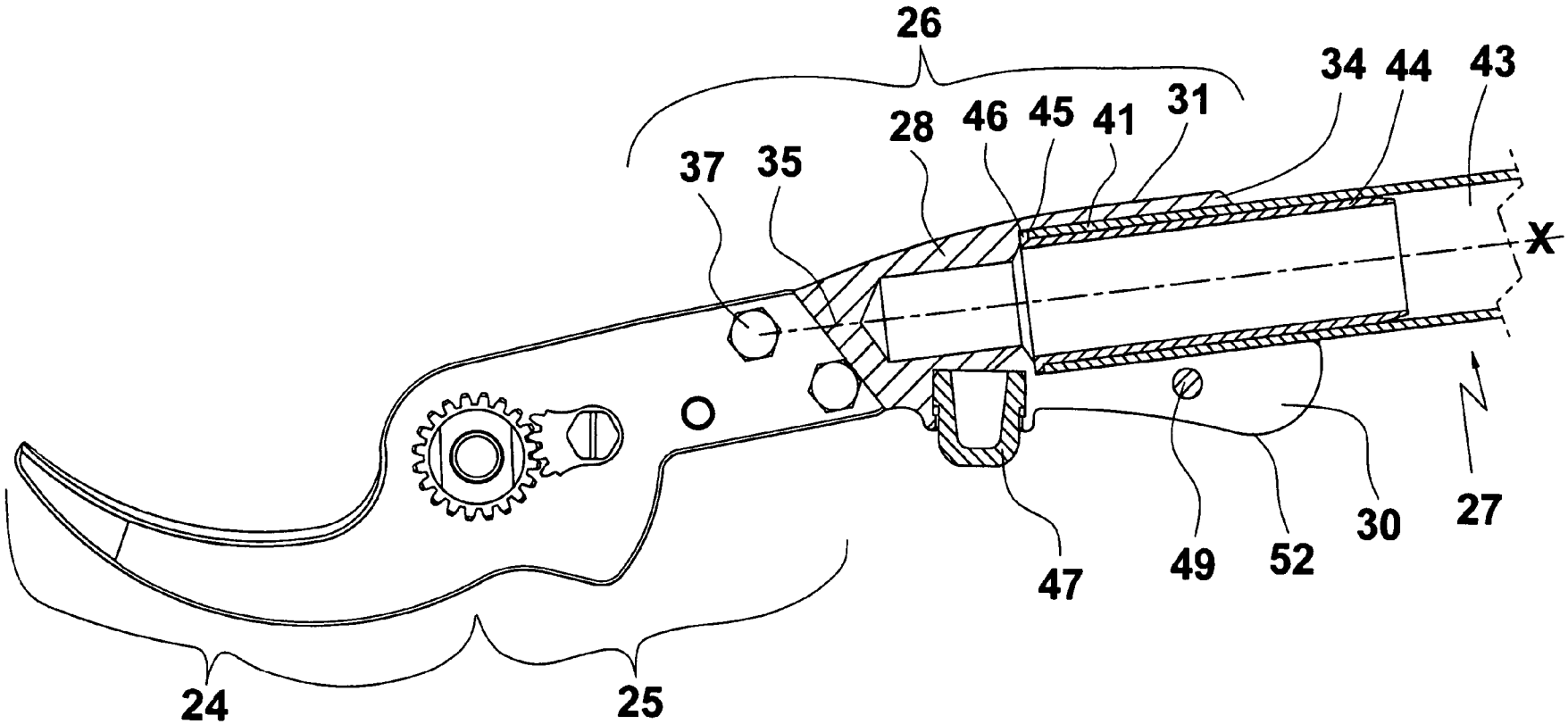
FIG. 8: a partial cutaway view of the arm of FIG. 7.

Represented in detail in FIGS. 7 and 8 is the arm 22. The connecting part or first piece 26 includes two parts substantially in the shape of half shells 28,42, one turned toward the other, connected by a hinge-forming part 31 and being prolonged at their respective end opposite the hinge-forming part 31, by clamping parts 29,30. The clamping part 29 includes a through hole 32 in which a screw 33 is accommodated that comes to screw into a threaded hole 49 of the clamping part 30. Before assembly, there exists a spacing 39 between the two clamping parts 29 and 30.

The half shells 28,42 are open at one side 34 to receive the handle 27; they form between them a substantially cylindrical space 40, and come together again at the side 35 which is opposite side 34. At the level of the side 35, they are prolonged by a flat end 36 extending substantially parallel to the longitudinal axis of the space 40. The flat end 36 includes two threaded holes 37 in which screws 48 are received, and a smooth hole 53 in which a pin 50 is received. Such a fixation system is well known to one skilled in the art.

A resilient stop 47 is provided in the piece 26, at side 35, between the flat end 36 and the clamping parts 29,30. In a known way, this resilient stop is turned toward the resilient stop of the other arm 22 so as to absorb the shocks when the pieces 26 of the arms 21,22 come into contact with one another during use of the tool.

Moreover, the clamping parts 29,30 each have an end which moves away from the axis X by taking the shape of a lobe 51,52, as can be seen very well in FIG. 8. These lobes 51,52 of the arm 22 are intended to abut their counterparts of the arm 21 (see FIG. 6). By acting as mechanical stops, they limit the coming together of the two arms 21,22, and in this way prevent the user from crushing his fingers when he uses the pruning shears according to the invention.

The handle 27 has the shape of a hollow cylinder. It is usually of a material having a polymeric matrix reinforced by pultruded carbon fibers. One of the ends of the handle 27, designated by the number 41, is accommodated inside the piece 26, i.e. in the space 40 where it penetrates through the opening situated at the side 34 of the piece 26.

In the end 41 of the handle 27, inside the cavity 43, there is a bushing 44 in the form of a hollow cylinder. This bushing 44 is usually a piece made of machined aluminum. It extends in part of the cavity 43, starting from the rim 45 of the end 41 of the handle 27, following the axis X of the handle 27. This axis X is substantially parallel to the hinge-forming part 31. The bushing 44 has a length which is greater than the maximal length of the end 41 located in the space 40. The bushing 44 includes, at one end, a collar 46 coming to abut against the rim 45 of the end 41, in order to limit its penetration into the cavity 43 of the handle 27. The collar 46 likewise comes to abut against an inner wall of the space 40 when the end 41 is inserted completely into this space.

The inner diameter of the handle 27, i.e. the diameter of the cavity 43, as well as the outer diameter of the bushing 44 are conceived such that there is play during the assembly. In a similar way, the dimensions of the space 40 of the piece 26, the outer diameter of the handle 27 and the outer diameter of the collar 46 of the bushing 44 are conceived such that there is play during the assembly. These instances of play disappear upon tightening of the screw 33, owing to the flexibility of the piece 26.

Under the effect of the force exerted by the screw 33, the spacing 39 between the clamping parts 29, 30 diminishes owing to the flexibility of the piece 26 and the role as hinge played by the hinge-forming part 31. The parts 29,30 are thus brought together, and they grip the end 41, which well resists the pressing stress owing to the reinforcement provided by the bushing 44. In this way it is possible to attach the handle 27 firmly to the piece 26. Such an attachment advantageously allows the forces exerted on the handle 27 to be transmitted to the piece 26, without risk of breakage or torsion of said handle.

To assemble a pair of pruning shears according to the invention, one begins by first putting together, by means of the articulation 23, a cutting part 24 and its transmission part 25 of an arm 21, with the cutting part 24 and its transmission part 25 of an arm 22. One of the cutting parts 24 plays the role of blade and the other that of counter-blade.

Next, a connecting part 26 is fixed on each transmission part 25 by means of the flat end 36, screws 48 and corresponding holes 37.

Then, a bushing 44 is inserted into a handle 27, until the collar 46 of the bushing 44 comes to abut against the rim 45 of the handle 27. This step is carried out twice (because there are two arms in a pair of pruning shears). Needless to say this step can be the subject of a preassembly, i.e. it can be achieved before the aforementioned assembly of one arm with the other.

Then, for each arm 21, 22, the assembly handle 27+bushing 44 is inserted in the space 40 of a piece 26, until each collar 46 comes to abut against an inner wall of the space 40 of the corresponding piece 26. The free end of each handle 27 usually has a sleeve tube of plastic which is often colored.

Finally, for each arm 21,22, a screw 33 is slipped into a hole 32, and the screw 33 is tightened in the corresponding hole 49, in order to immobilize each handle 27 in a piece 26.

The pruning shears according to the invention can be taken apart easily. To do this, first the screw 33 is unscrewed. Thanks to the dimensioning of the pieces and to the flexibility of the piece 26, the spacing apart increases, thus play is created again between the piece 26 and the handle 27. The latter can thus be removed from the piece 26 using bare hands. The bushing 44 can then be pulled out of the end 41, likewise using bare hands.

The invention thus makes it possible to provide pruning shears with interchangeable handles. In fact, the user is thus able to replace easily and at any time the handles of a pair of pruning shears with other handles of the same diameter, but shorter or longer, of a different color, in a different material, etc. If he wishes to use handles (and bushings) of a different diameter, he can also replace the piece 26 with another piece 26 having an adapted space 40.

The information just given concerning the manufacture of a pair of pruning shears could easily be adapted to the production of a bicycle frame, a golf club, a tripod for a photographic device or camera, etc.

The invention claimed is:

1. A tool for cutting, shearing, clamping or gripping, having a first piece, a hollow second piece, and two arms connected to one another by means of an articulation, wherein the first piece has an upper part and a lower part which are connected by a hinge-forming part and form between them a space;

a part of the hollow second piece is accommodated in said space;

the hollow second piece includes a cavity and a bushing that is provided in at least part of the cavity, the bushing being provided at a level of a part of the hollow second piece that is accommodated in the first piece, the bushing extending beyond an end portion of the first piece in a direction toward the hollow second piece; and the first piece being formed of a material having a high mechanical resistance and the hollow second piece being formed of a material having a low radial mechanical resistance, wherein the tool further comprises:

clamping means which bring together said upper and lower parts of the first piece.

2. The tool according to claim 1, wherein the first piece is made up of a metal or a metal alloy.

3. The tool according to claim 1, wherein the hollow second piece is made up of a composite material.

4. The tool according to claim 2, wherein the hollow second piece is made up of a composite material.

5. The tool according to claim 3, wherein the composite material is constituted by a polymeric matrix reinforced by carbon fibers.

6. The tool according to claim 1, each arm having:

a cutting part, a transmission part, and a manipulation part, each arm further comprising a connecting part between the transmission part and the manipulation part;

the connecting part constituting said first piece, and the manipulation part constituting said hollow second piece.

7. The tool according to claim 6, in particular pruning shears for two hands, wherein the connecting part is of aluminum or an aluminum alloy.

* * * * *

UNITED STATES PATENT AND TRADEMARK OFFICE

CERTIFICATE OF CORRECTION

PATENT NO. : 7,654,005 B2
APPLICATION NO. : 11/476683
DATED : February 2, 2010
INVENTOR(S) : Laurent Perrin It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 692 days.

Signed and Sealed this

Twenty-third Day of November, 2010

David J. Kappos

David J. Kappos
*Director of the United States Patent and Trademark Office*